US010088128B2

(12) United States Patent
Umeda et al.

(10) Patent No.: US 10,088,128 B2
(45) Date of Patent: Oct. 2, 2018

(54) ILLUMINATING DEVICE

(71) Applicant: TOYODA GOSEI CO., LTD., Kiyosu-shi (JP)

(72) Inventors: Yukihiko Umeda, Kiyosu (JP); Koichiro Endo, Kiyosu (JP)

(73) Assignee: TOYODA GOSEI CO., LTD., Kiyosu-shi, Aichi-Ken (JP)

( * ) Notice: Subject to any disclaimer, the term of this patent is extended or adjusted under 35 U.S.C. 154(b) by 0 days.

(21) Appl. No.: 15/433,860

(22) Filed: Feb. 15, 2017

(65) Prior Publication Data

US 2017/0276323 A1 Sep. 28, 2017

(30) Foreign Application Priority Data

Mar. 25, 2016 (JP) ..... 2016-062886

(51) Int. Cl.

| | |
|---|---|
| ***F21V 7/04*** | (2006.01) |
| ***F21V 13/04*** | (2006.01) |
| ***F21V 5/04*** | (2006.01) |
| ***F21V 21/08*** | (2006.01) |
| *F21V 7/00* | (2006.01) |

(52) U.S. Cl.

CPC ..... *F21V 13/04* (2013.01); *F21V 5/04* (2013.01); *F21V 7/04* (2013.01); *F21V 21/08* (2013.01); *F21V 7/0025* (2013.01)

(58) Field of Classification Search

CPC ..... F21V 7/0025; F21V 7/0066; F21V 7/04; F21V 7/05; F21V 5/00; F21V 5/04; F21V 5/043; F21V 5/046; F21V 13/04; F21V 21/08

See application file for complete search history.

(56) References Cited

U.S. PATENT DOCUMENTS

| | | | | |
|---|---|---|---|---|
| 2,223,059 | A * | 11/1940 | Donley | B60Q 1/34 116/202 |
| 2007/0159854 | A1 | 7/2007 | Kokubu et al. | |
| 2012/0327653 | A1* | 12/2012 | Van Gorkom | F21V 5/04 362/235 |
| 2013/0176741 | A1* | 7/2013 | Nakamura | F21V 13/12 362/347 |
| 2014/0078728 | A1* | 3/2014 | Rodgers | F21V 5/008 362/225 |
| 2014/0146564 | A1* | 5/2014 | Im | G02B 6/0088 362/607 |

FOREIGN PATENT DOCUMENTS

JP 2007-185980 A 7/2007

* cited by examiner

*Primary Examiner* — Y. M. Lee

(74) *Attorney, Agent, or Firm* — McGinn I.P. Law Group PPLC.

(57) ABSTRACT

An illuminating device includes a light source having a light-source optical axis, a lens that is located substantially parallel to the light-source optical axis such that a surface of the lens faces the light-source optical axis, the lens extending to a position rearward of the light source in a direction of the light-source optical axis, and a light reflecting portion located so as to be opposed to a front side of the light source, the light reflecting portion being adapted to reflect emitted light of the light source obliquely rearward of the light source, and reflect the emitted light toward the lens.

18 Claims, 8 Drawing Sheets

ILLUMINATING DEVICE

INCORPORATION BY REFERENCE

The disclosure of Japanese Patent Application No. 2016-062886 filed on Mar. 25, 2016 including the specification, drawings and abstract is incorporated herein by reference in its entirety.

BACKGROUND

1. Technical Field

The disclosure relates to an illuminating device.

2. Description of Related Art

A light emitting device disclosed in Japanese Patent Application Publication No. 2007-185980 (JP 2007-185980 A) includes a light source, and a light guide body into which light is introduced from the light source, and the light source is housed in a housing portion formed on the upper surface side of the light guide body. In the light emitting device, a light emitting portion is formed which extends from a region located obliquely forward of the light source, to a region located on one side of the light source, and a region located obliquely rearward of the light source, in a portion of the lower surface of the light guide body which is not aligned with the light source and a location right below its optical axis. The light guide body contains a diffusing material.

SUMMARY

With the technology of JP 2007-185980 A, the width of the light guide body is increased by that of the light emitting portion formed in the region located on one side of the light source; therefore, reduction of the size of the light emitting device may be impeded. Although the light emitting portion that covers the region located obliquely rearward of the light source is formed, light is less likely or unlikely to be turned around obliquely rearward from one side of the light source in the light guide body. Therefore, it may be difficult to evenly or uniformly emit light from the entire area of a light radiation surface of the light guide body. In JP 2007-185980 A, it is stated that diffusion of light in the light guide body is promoted by use of the diffusing material, so that light having sufficient brightness is radiated from the entire area of the light emitting portion with small differences in luminance. However, if the diffusing material is contained in the light guide body, the light is more likely to be attenuated depending on the light guide distance. Thus, it is still difficult to uniformly emit light from the entire area of the light radiation surface of the light guide body, even with the use of the diffusing material.

The disclosure provides an illuminating device that can be reduced in size, and can uniformly emit light from the entire area of its light radiation surface.

An illuminating device according to one aspect of the disclosure includes a light source having a light-source optical axis, a lens that is located substantially parallel to the light-source optical axis such that a surface of the lens faces the light-source optical axis, the lens extending to a position rearward of the light source in a direction of the light-source optical axis, and a light reflecting portion located so as to be opposed to a front side of the light source, the light reflecting portion being adapted to reflect emitted light of the light source obliquely rearward of the light source, and reflect the emitted light toward the lens.

According to the above aspect of the disclosure, the width of the illumination device as measured in its short-side direction can be reduced, and the size of the illuminating device can be reduced, as compared with the technology of JP 2007-185980 A with which reduction of the size may be impeded (the width of the light guide body is increased by that of the light emitting portion formed in the region located on one side of the light source).

In the illuminating device of the above aspect, since the light reflecting portion is provided, the emitted light can be easily turned around obliquely rearward of the light source, and light can be evenly or uniformly emitted from the entire area of the light radiation surface of the lens, which area extends from the front side of the light source to the back side thereof. As a result, light having an elongate shape along the longitudinal direction of the case and the lens can be radiated from the illuminating device.

In the illuminating device of the above aspect, a light reflecting surface of the light reflecting portion may be an inclined surface that is inclined so as to be closer to the light source in a direction of the light-source optical axis, as a distance from the light-source optical axis in a direction perpendicular to the surface of the lens increases.

With this arrangement, the light radially emitted from the light source can be reflected obliquely rearward of the light source along the longitudinal direction of the lens, and the light reflecting portion that surely achieves the effect of the above aspect can be realized.

In the illuminating device of the above aspect, the illuminating device further may include a case in which the light source is provided in an end portion of the case in a longitudinal direction of the case, the light-source optical axis may extend in the longitudinal direction in the case, the lens may be located with a gap provided between the lens and an inner bottom surface of the case, and the light reflecting portion may be located in the case.

With this arrangement, since the gap is formed between the case and the lens, the light emitted from the light source in the direction of the light-source optical axis is reflected by the inner surface of the case toward the lens, while spreading throughout the gap between the case and the lens, so as to be radiated from the light radiation surface of the lens to the outside of the illuminating device.

In the illuminating device of the above configuration, the case may be substantially in a shape of a rectangular parallelepiped box, and may have an opening, the lens may be fitted in the opening of the case, and the light-source optical axis may be arranged to pass through space formed by a gap between the case and the lens, without being interrupted by the case, the lens, and the light reflecting portion.

With the above arrangement, the light on the light-source optical axis, which has a large quantity of light, out of the emitted light of the light source, travels within the space formed by the gap between the case and the lens. Therefore, the light is less likely to be attenuated, as compared with the case where the emitted light travels within the light guide body as in the light emitting device of JP 2007-185980 A. Thus, the quantity of light radiated from a region of the light radiation surface of the lens, which is distant from the light source, can be increased, and the luminous efficiency of the illuminating device can be enhanced.

In the illuminating device of the above configuration, the light reflecting portion may be connected to the inner bottom surface of the case, and a height of the light reflecting portion as measured from the inner bottom surface of the case may be about one-half of a gap between the case and the lens. Also, the height of the light reflecting portion as measured from the inner bottom surface of the case may be in a range of ⅓ to ⅔ of a gap between the case and the lens. Also, the height of the light reflecting portion as measured from the inner bottom surface of the case may be in a range of ⅓ to ½ of a gap between the case and the lens.

With the above arrangement, the emitted light of the light source can be prevented from being excessively interrupted by the light reflecting portion, and a sufficient quantity of light can be radiated obliquely rearward of the light source, while at the same time a sufficient quantity of light can be radiated forward of the light reflecting portion. Thus, the effect of the above aspect can be further surely obtained.

In the illuminating device of the above configuration, the case may have an inner surface having light reflectivity.

With the above arrangement, the width of the illumination device as measured in its short-side direction can be reduced, and the size of the illuminating device can be reduced, as compared with the technology of JP 2007-185980 A with which reduction of the size may be impeded (the width of the light guide body is increased by that of the light emitting portion formed in the region located on one side of the light source).

In the illuminating device of the above aspect, the light reflecting portion may include a first member and a second member, the first member and the second member may be symmetric with respect to the light-source optical axis, and the light-source optical axis may be arranged to pass through a gap provided between the first member and the second member.

With the above arrangement, the light that travels along the light-source optical axis, as a part of the emitted light of the light source, passes through the gap between the first member and the second member of the light reflecting portion. Therefore, the emitted light of the light source is prevented from being excessively interrupted by the light reflecting portion, and the effect of the above arrangement can be further surely obtained.

In the illuminating device of the above aspect, a thickness of a bottom wall portion of the lens may increase toward a front end of the lens.

With the above arrangement, the emitted light of the light source is more likely to be incident on the inner surface of the lens and refracted as the light approaches the front end of the lens, so that the light can be radiated from the light radiation surface of the lens, farther on the front side of the illuminating device. Thus, the illuminating device can illuminate a wide area along the longitudinal direction of the case and the lens.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1A:
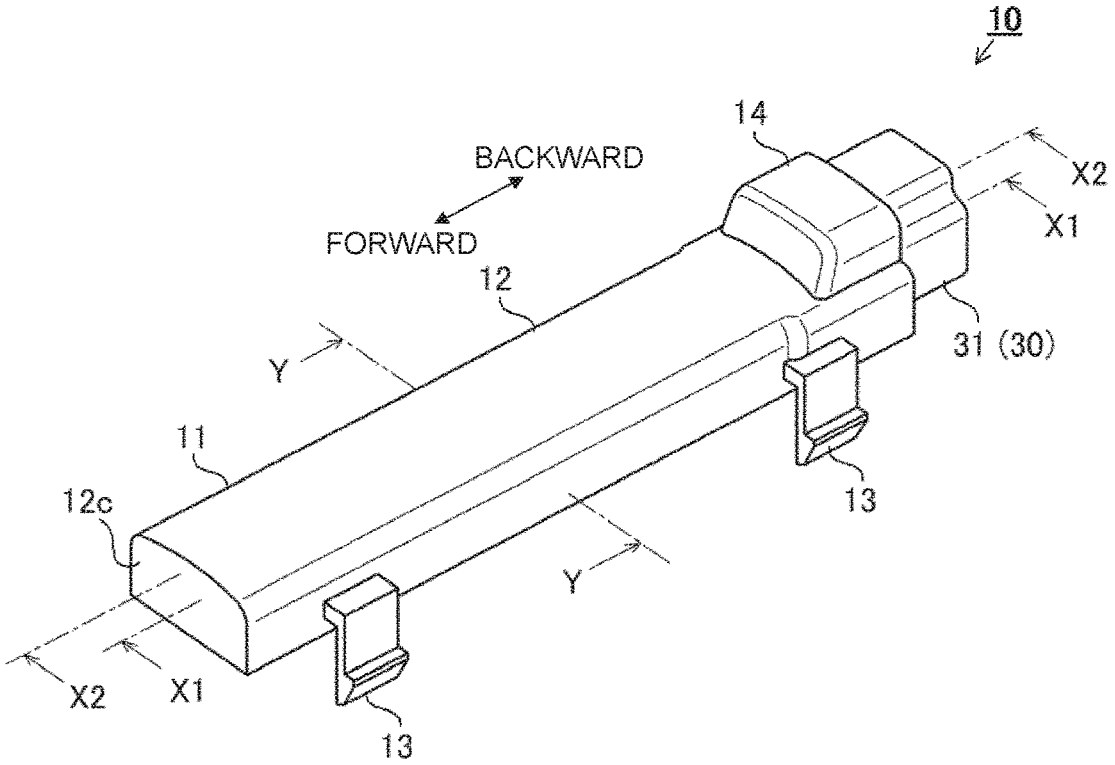
FIG. 1A is a perspective view of an illuminating device 10 as one embodiment of the disclosure, when it is viewed from the upper side.
Figure 1B:
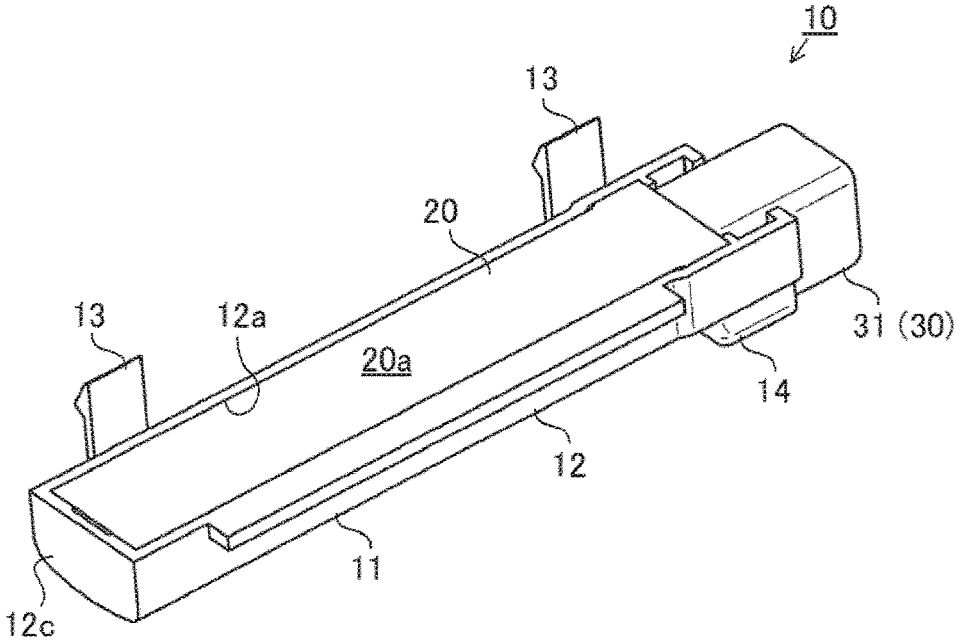
FIG. 1B is a perspective view of the illuminating device 10 as viewed from the lower side.

In the following, one embodiment of the disclosure will be described with reference to the drawings. In each of the drawings, constituent members are schematically illustrated with some dimensions, shapes and positions of the members exaggerated, for the sake of easy understanding of the description, and the dimensions, shapes and positions of the illustrated constituent members do not necessarily conform with those of the actual members.

As shown in FIG. 1A through FIG. 8, an illuminating device 10 of this embodiment includes a case 11 (main body 12, opening 12*a*, inner bottom surface 12*b*, front end wall portion 12*c*, exterior mounting portions 13, light-source mounting portion 14, light reflecting portions 15, 16, light reflecting surfaces 15*a*, 16*a*), a lens 20 (light radiation surface 20*a*, side wall portions 20*b*, front end portion 20*c*, inner bottom surface 20*d*, inner corner portions 20*e*, engaging projections 21), a light source assembly 30 (connector portion 31, light source 32, light-source optical axis L), space S, and so forth. The illuminating device 10 is used as a vehicle interior illuminating device (e.g., inside door handle lamp, map lamp, room lamp, foot lamp, etc.).

The case (or cover, housing) 11 is substantially in the shape of a rectangular parallelepiped box as a whole, and includes a main body 12 (opening 12*a*, inner bottom surface 12*b*, front end wall portion 12*c*), exterior mounting portions 13, light-source mounting portion 14, light reflecting portions 15, 16 (light reflecting surfaces 15*a*, 16*a*), and so forth. The inner surface of the case 11 has light reflectivity. The main body 12 is substantially in the shape of a hollow, rectangular parallelepiped box, which has an opening 12*a* where the entire area of the lower side of the main body 12 is open, and is also open at a rear end face thereof. An inner bottom surface 12*b* of the main body 12 is formed as a curved surface that is slightly curved in concave form along a short-side direction of the main body 12, and is formed flat in the longitudinal direction of the main body 12. The front end of the main body 12 is closed by a front end wall portion 12*c* that is erected perpendicular to the inner bottom surface 12*b*.

The exterior mounting portions 13 are in the form of right-angled hooks each formed from an L-shaped plate, and protrude from an outer surface of one side wall portion of the main body 12, toward the opening 12*a*, in the vicinity of longitudinally opposite end portions of the main body 12. The light-source mounting portion 14 is substantially U-shaped in vertical section such that it is open at its lower side and front and rear ends. The light-source mounting portion 14 is connected to the rear end face of the main body 12. The light reflecting portions 15, 16 are erected in the vicinity of a rear end portion of the main body 12, so as to be connected to the inner bottom surface 12*b* and inner side faces. The entire areas of portions of the light reflecting portions 15, 16, which are opposed to the light-source mounting portion 14, provide flat, light reflecting surfaces 15*a*, 16*a*, and the light reflecting surfaces 15*a*, 16*a* are located/formed so as to provide inclined surfaces that form acute angles with respect to the opening 12*a* and rear end face of the main body 12.

The lens 20 is hollow and substantially U-shaped in vertical section, and the entire area of the lower surface of the lens 20 provides a flat, light radiation surface 20*a*. Side wall portions 20*b* of the lens 20 are formed along the longitudinal direction, on the opposite sides of the lens 20 as viewed in the short-side direction, and three engaging projections 21 are mounted on an outer surface of each of the opposite side wall portions 20*b*, so as to protrude from the outer surface. In a front end portion 20*c* of the lens 20, a bottom wall portion of the lens 20 is formed such that its thickness increases toward the front end, and an inner bottom surface 20*d* of the lens 20 provides a concave, curved surface that is curved along the longitudinal direction of the lens 20. As viewed in the longitudinal direction of the lens 20, the inner bottom surface 20*d* excluding the front end portion 20*c* is formed as a flat surface, and the bottom wall portion excluding the front end portion 20*c* is formed with uniform thickness. An inner corner portion 20*e* that connects the inner bottom surface 20*d* of the lens 20 and each of the inner side faces is round-shaped.

The light source assembly 30 includes a connector portion 31 and a light source 32. The connector portion 31 is open at its rear end face (not shown), and an external connection terminal (not shown) is provided in the connector portion 31, to constitute a male-side connector. The light source 32 is a LED (Light Emitting Diode) in the form of a bullet-like package having a light-source optical axis L that extends along the center axis. The light source 32 is attached and fixed to a front end portion of the connector portion 31, and is electrically connected to the external connection terminal in the connector portion 31.

Figure 5:
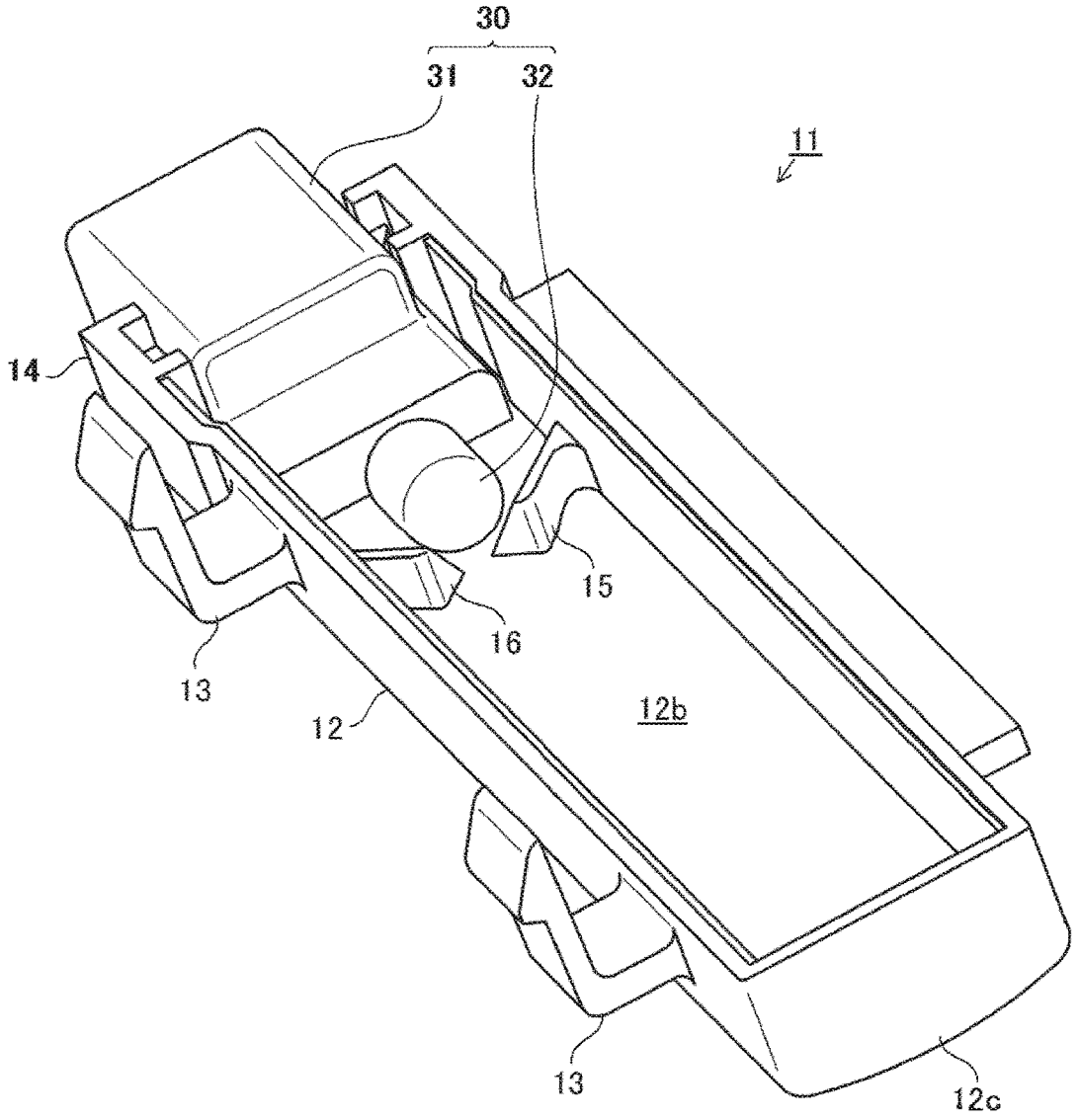
FIG. 5 is a perspective view of the case 11 in a condition where a light source assembly 30 is attached and fixed to the case 11.
Figure 6A:
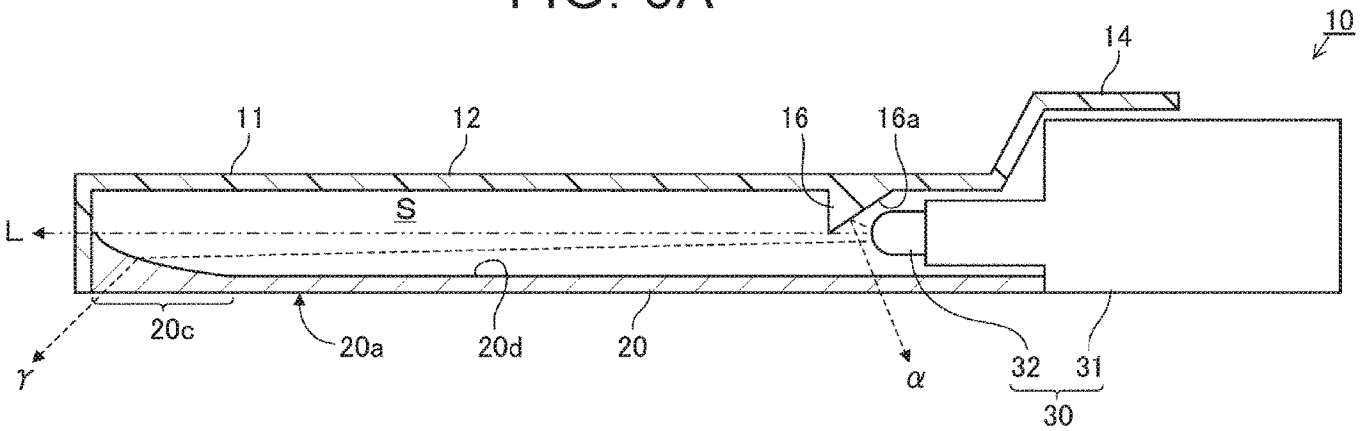
FIG. 6A is an end elevational view in vertical section of the illuminating device 10 (end elevational view of a section indicated by arrows X1-X1 shown in FIG. 1A)
Figure 6B:
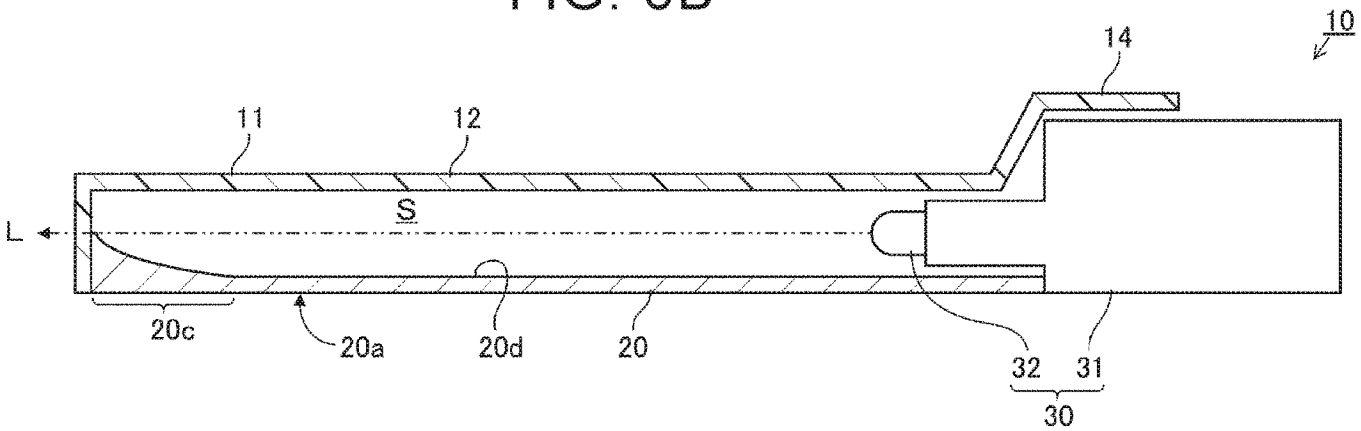
FIG. 6B is an end elevational view in vertical section of the illuminating device 10 (end elevational view of a section indicated by arrows X2-X2 shown in FIG. 1A)

To assemble the illuminating device 10, the light source assembly 30 is initially fitted in the light-source mounting portion 14 of the case 11, to be attached and fixed to the case 11 (see FIG. 5, FIG. 6A, and FIG. 6B). Then, the lens 20 is fitted in from the lower side of the case 11, to be attached and fixed to the case 11 (see FIG. 1A, FIG. 1B, and FIG. 6A to FIG. 8). Then, the illuminating device 10 is mounted and fixed to a member (such as an inside door handle bezel) in the vehicle interior, by engaging the exterior mounting portions 13 of the case 11 with the vehicle interior member. Then, a female-side connector (not shown) of wire harnesses of the automobile is inserted into and fixed to the connector portion 31 of the light source assembly 30, and the female-side connector is electrically connected to the external connection terminal in the connector portion 31, so that electric power is supplied from the automobile to the light source assembly 30, so as to turn on the light source 32.

In the illuminating device 10 that is in an assembled state, the light radiation surface 20*a* of the lens 20 is exposed from the opening 12*a* of the case 11, and an outer peripheral portion of the opening 12*a* is flush with the light radiation surface 20*a* (see FIG. 1A, FIG. 1B, FIG. 6A, FIG. 6B, and FIG. 8). Also, the outer surfaces of the opposite side wall portions 20*b* of the lens 20 are in contact with the inner surfaces of the opposite side wall portions of the case 11, and the outer surface of the front end portion of the lens 20 is in contact with the inner surface of the front end wall portion 12*c* of the case 11, while the engaging projections 21 of the lens 20 are engaged with the inner side surfaces of the main body 12 and the light-source mounting portion 14 of the case 11. With this arrangement, the lens 20 is attached and fixed to the case 11 such that the lens 20 cannot fall out of the case 11.

The case 11 and the lens 20 are hollow, and a gap is formed between the inner bottom surface 12*b* of the case 11 and the inner bottom surface 20*d* of the lens 20, such that space S formed by the gap is provided. The center axis of the case 11 coincides with the light-source optical axis L of the light source 32 of the light source assembly 30, and the light-source optical axis L that extends in the longitudinal direction of the case 11 is arranged to pass through the space S without being interrupted by the case 11, lens 20, and the light reflecting portions 15, 16. The lens 20 extends to a position rearward of the light source 32, and the light radiation surface 20*a* of the lens 20 is located/formed so as to cover the lower sides of the light source 32 and a front portion of the connector portion 31.

A front end portion of the light source 32 is located close to and opposed to the light reflecting surfaces 15*a*, 16*a* of the light reflecting portions 15, 16 of the case 11. The light reflecting portions 15, 16 are symmetric with respect to the light-source optical axis L, and are positioned such that the light-source optical axis L passes through a gap formed between the light reflecting portions 15, 16 (see FIG. 1A, an FIG. 5 to FIG. 7). The height of the light reflecting portions 15, 16 as measured from the inner bottom surface 12*b* of the case 11 is about one-half of the gap between the inner bottom surface 12*b* of the case 11 and the inner bottom surface 20*d* of the lens 20. The light reflecting surfaces 15*a*, 16*a* of the light reflecting portions 15, 16 are flat surfaces, and the light reflecting portions 15, 16 are arranged/formed in a truncated chevron shape, such that the light reflecting surfaces 15*a*, 16*a* provide inclined surfaces that form acute angles with respect to the light radiation surface 20*a* of the lens 20 and the light-source optical axis L.

The case 11 is integrally formed by injection molding, using a resin material having sufficient strength. The light reflectivity is given to the inner surface of the case 11, including the light reflecting surfaces 15*a*, 16*a* of the light reflecting portions 15, 16, by any of the following methods. A first method is to add a white pigment (such as titanium oxide, or aluminum oxide) having high light reflectivity, to the resin material of the case 11. A second method is to coat the inner surface of the case 11 with a coating material including a white pigment or powder of a metal material (such as chromium, indium, aluminum, silver, gold, and alloys of these metal materials), which has high light reflectivity. A third method is to form a light reflective thin film of a metal material having high light reflectivity, by PVD (Physical Vapor Deposition) or plating.

The lens 20 is integrally formed by injection molding, using a resin material having light permeability. The resin material may be selected from, for example, PMMA (polymethylmethacrylate), PC (polycarbonate), PC/ABS (acrylonitrile butadiene styrene) alloy, PET (polyethylene terephthalate), etc. Of the resin materials of the lens 20, PC is the most favorable material since it is inexpensive, and has excellent injection moldability and resistance to weather and a high degree of transparency. Also, fine particles of a material (such as silica, titanium oxide, or aluminum oxide) having high light diffusion capability (light scattering capability) may be added as a light diffusing material to the resin material of the lens 20, so that the light diffusing material is contained in the lens 20. In this case, since the light diffusion capability of the lens 20 is enhanced by the light diffusing material, light can be further uniformly emitted from the entire area of the light radiation surface 20*a* of the lens 20. If the light diffusing material is contained in the lens 20, the internal structure of the illuminating device 10 including the light reflecting portions 15, 16 is less likely to be visually recognized through the lens 20 when the light source 32 is not turned on; therefore, the appearance of the illuminating device 10 can be improved.

The light source 32 is not limited to the LED, but any type of light source may be used as the light source 32 provided that a sufficient quantity of light can be obtained. For example, a semiconductor light-emitting device (such as EL (electroluminescence), or LD (laser diode), an electric light bulb, or the like, may be used as the light source.

According to the illuminating device 10 of this embodiment, the following effects can be obtained.

1. The illuminating device 10 includes the case 11 whose inner surface has light reflectivity, light source 32 that is provided in the case 11 and attached to the rear end portion of the case 11 as viewed in the longitudinal direction, such that the light-source optical axis L extends in the longitudinal direction of the case 11, lens 20 that is located with a gap provided between the lens 20 and the inner bottom surface 12*b* of the case 11, and extends to a position rearward of the light source 32, and the light reflecting portions 15, 16 located in the case 11 to be opposed to the front side of the light source 32. As indicated by arrow a of FIG. 6A and arrows α, β of FIG. 7, the light reflecting portions 15, 16 reflect emitted light of the light source 32 obliquely rearward of the light source 32, and also reflect the emitted light toward the lens 20.

In this embodiment, the width of the illuminating device 10 as measured in the short-side direction can be reduced, and the size of the illuminating device 10 can be reduced, as compared with the technology of JP 2007-185980 A having a possibility of impeding reduction of the size (the width of the light guide body is increased by that of the light emitting portion formed in a region located on one side of the light source).

In the illuminating device 10, the gap is formed between the case 11 and the lens 20; therefore, the light emitted from the light source 32 in the direction of the light-source optical axis L is reflected by the inner surface (inner bottom surface 12*b* and inner side faces) of the case 11 toward the lens 20, while spreading throughout the space S formed by the gap between the case 11 and the lens 20, and is emitted from the light radiation surface 20*a* of the lens 20 to the outside of the illuminating device 10. Since the illuminating device 10 includes the light reflecting portions 15, 16, the emitted light can be easily turned around obliquely rearward of the light source 32, and the light can be evenly or uniformly emitted from the entire area of the light radiation surface 20*a* of the lens 20, which extends from the front side to the back side of the light source 32. As a result, light having an elongate shape that extends along the longitudinal direction of the case 11 and the lens 20 can be radiated from the illuminating device 10.

2. The light reflecting surfaces 15*a*, 16*a* of the light reflecting portions 15, 16 are flat surfaces, and the light reflecting portions 15, 16 are arranged in a truncated chevron shape, so as to provide inclined surfaces that form acute angles with respect to the light radiation surface 20*a* of the lens 20 and the light-source optical axis L. In other words, the light reflecting surfaces 15*a*, 16*a* of the light reflecting portions 15, 16 are inclined surfaces that are inclined so as to be closer to the light source 32 in the direction of the light-source optical axis L, as a distance from the light-source optical axis L in a direction perpendicular to the inner bottom surface 12*b* of the main body 12 of the case 11 (in a direction perpendicular to the inner bottom surface 20*d* of the lens 20) increases. With the light reflecting surfaces 15*a*, 16*a* thus configured, the light radially emitted from the light source 32 can be reflected obliquely rearward of the light source 32 along the longitudinal direction of the lens 20, so that the light reflecting portions 15, 16 that surely yield the effects of the above paragraphs 1 can be realized.

3. The case 11 is substantially in the shape of a rectangular parallelepiped box, and has the opening 12*a* of the main body 12, and the lens 20 is fitted in the opening 12*a*. The light-source optical axis L is arranged to pass through the space S formed by the gap between the case 11 and the lens 20, without being interrupted by the case 11, lens 20, and the light reflecting portions 15, 16. Accordingly, the light on the light-source optical axis L, which has a large quantity of light, out of the emitted light of the light source 32, travels within the space S formed by the gap between the case 11 and the lens 20; therefore, the light is less likely to be attenuated, as compared with the case where the emitted light travels within the light guide body as in the light emitting device of JP 2007-185980 A. Thus, the quantity of light emitted from a region of the light radiation surface 20*a* of the lens 20, which region is located apart from the light source 32, can be increased, and the light emitting efficiency of the illuminating device 10 can be enhanced.

Figure 7:
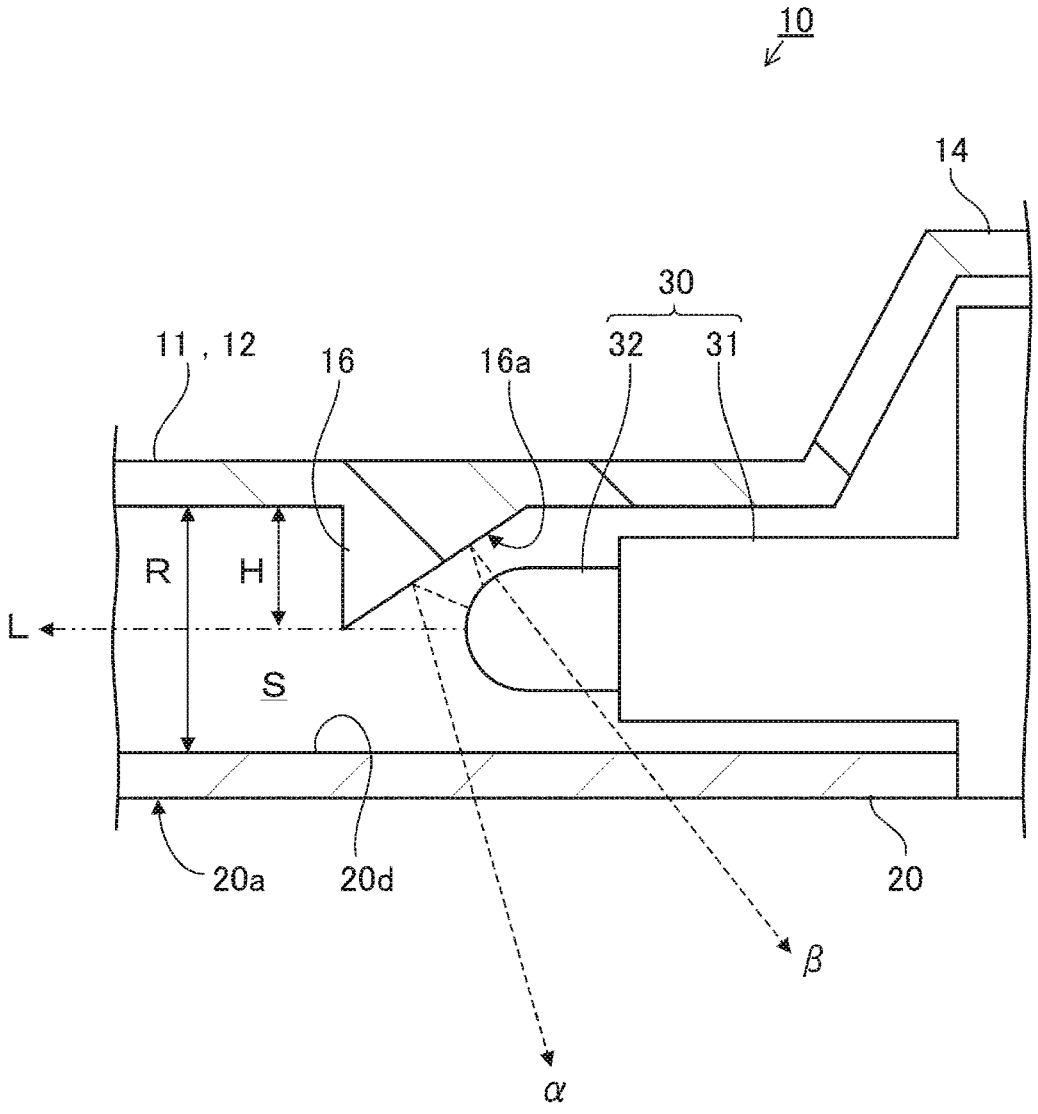
FIG. 7 is an end elevational view in vertical section of the illuminating device 10 (enlarged view of a principal part of FIG. 6A)

4. As shown in FIG. 7, the light reflecting portions 15, 16 are connected to the inner bottom surface 12*b* of the main body 12 of the case 11, and the height H of the light reflecting portions 15, 16 as measured from the inner bottom surface 12*b* is about one-half (=½) of the gap R between the inner bottom surface 12*b* of the main body 12 of the case 11 and the inner bottom surface 20*d* of the lens 20 (H≈R/2). Therefore, the light reflecting portions 15, 16 can be prevented from excessively interrupting the emitted light of the light source 32, and a sufficient quantity of light is radiated toward the front side of the light reflecting portions 15, 16, while at the same time a sufficient quantity of light is radiated obliquely rearward of the light source 32. Thus, the effects of the above paragraphs 1 can be further surely obtained.

The ratio of the height H to the gap R is appropriately in the range of ⅓ to ⅔, desirably in the range of ⅓ to ½, and particularly desirably, is equal to ½. If the ratio of the height H to the gap R is smaller than this range, the area of the light reflecting surfaces 15*a*, 16*a* of the light reflecting portions 15, 16 is excessively small; therefore, the quantity of light reflected by the light reflecting surfaces 15*a*, 16*a* is reduced, thus making it difficult to radiate a sufficient quantity of light obliquely rearward of the light source 32.

If the ratio of the height H to the gap R is larger than this range, the area of the light reflecting surfaces 15*a*, 16*a* of the light reflecting portions 15, 16 is excessively large; therefore, the light reflecting portions 15, 16 are likely to excessively interrupt the emitted light of the light source 32, thus making it difficult to radiate a sufficient quantity of light to the front side of the light source 32. Also, if the ratio of the height H to the gap R is larger than this range, distal ends of the light reflecting portions 15, 16 are located close to the lens 20; therefore, the light reflecting portions 15, 16 are more likely to be visually recognized through the lens 20 when the light source 32 is not turned on, and the appearance of the illuminating device 10 may deteriorate.

5. As shown in FIG. 5 to FIG. 7, the illuminating device 10 includes two light reflecting portions 15, 16 (first member, second member), and the light reflecting portions 15, 16 are symmetric with respect to the light-source optical axis L, and are arranged such that the light-source optical axis L passes through the gap formed between the light reflecting portions 15, 16. Thus, since the light that travels along the light-source optical axis L, out of the emitted light of the light source 32, passes through the gap of the light reflecting portions 15, 16, the light reflecting portions 15, 16 are prevented from excessively interrupting the emitted light of the light source 32, and the effects of the above paragraphs 4 can be further surely obtained.

6. As shown in FIG. 6A and FIG. 6B, the front end portion 20*c* of the lens 20 is formed such that the thickness of the bottom wall portion of the lens 29 increases toward the front end, and the inner bottom surface 20*d* of the lens 20 is a concave, curved surface that is curved along the longitudinal direction of the lens 20. Accordingly, the emitted light of the light source 32 is more likely to be incident on the inner bottom surface 20*d* of the lens 20 as the light approaches the front end of the lens 20, and is refracted as indicated by arrow y in FIG. 6A, so that the light can be radiated from the light radiation surface 20*a* of the lens 20, farther on the front side of the illuminating device 10. Thus, the illuminating device 10 can illuminate a wide area along the longitudinal direction of the case 11 and the lens 20.

Figure 2:
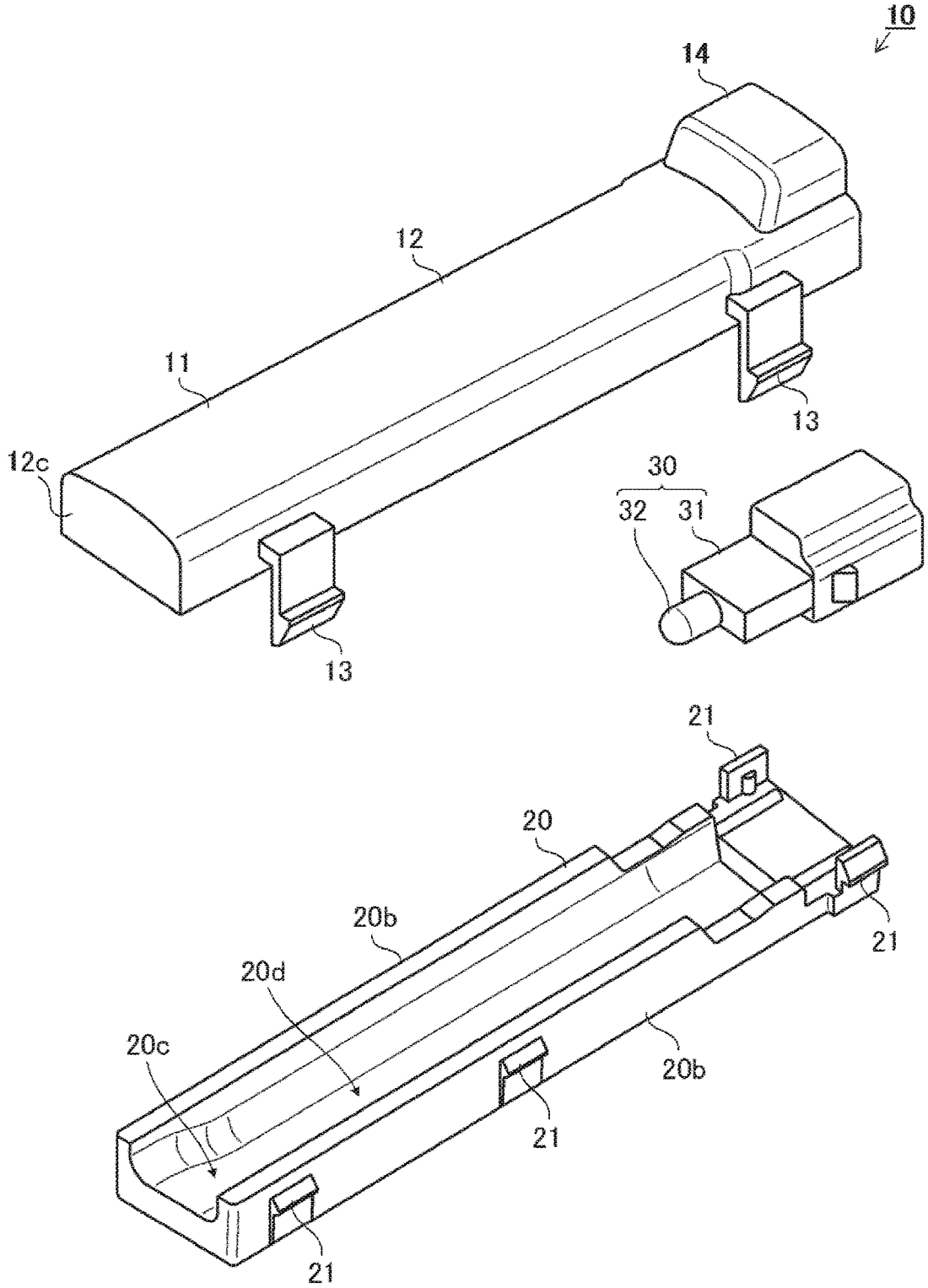
FIG. 2 is an exploded, perspective view of the illuminating device 10 as viewed from the upper side.
Figure 3:
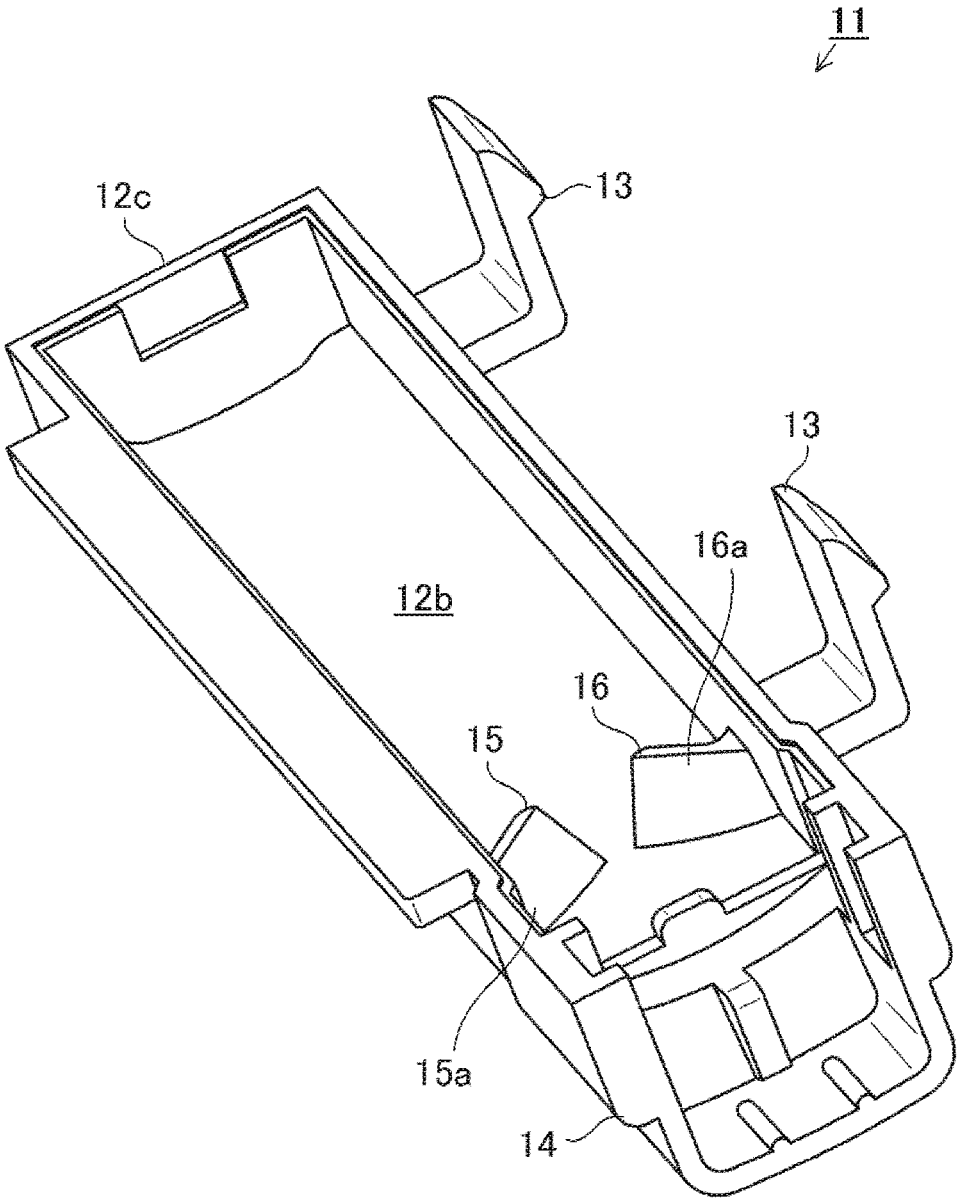
FIG. 3 is a perspective view of a case 11 of the illuminating device 10 as viewed from the lower, back side.
Figure 4:
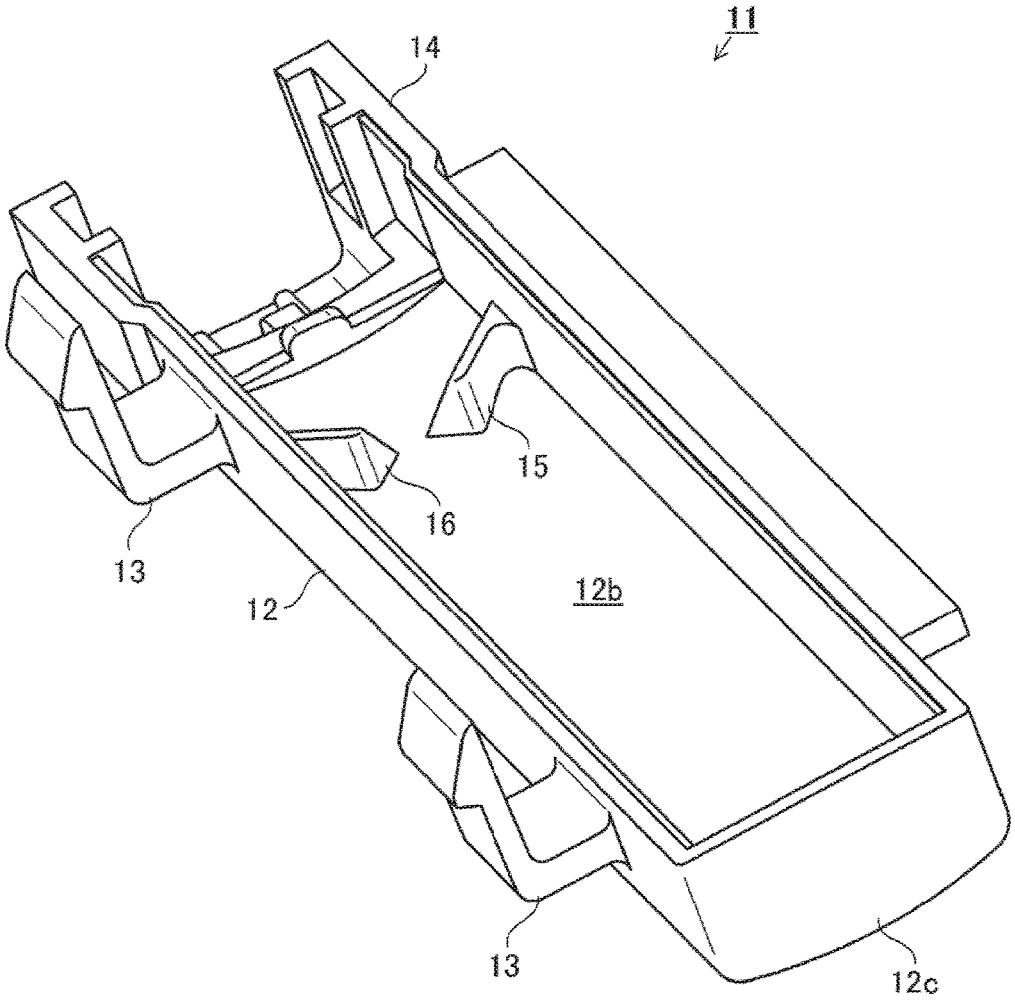
FIG. 4 is a perspective view of the case 11 as viewed from the lower, front side.
Figure 8:
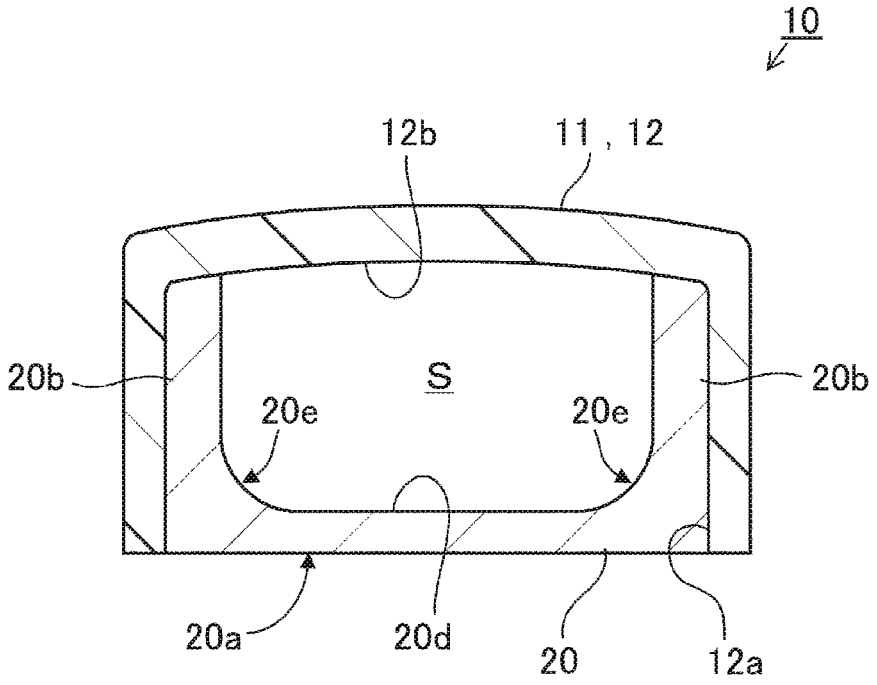
FIG. 8 is an end elevational view in vertical section of the illuminating device 10 (end elevational view of a section indicated by arrows Y-Y shown in FIG. 1A).

7. As shown in FIG. 2 and FIG. 8, the lens 20 is substantially U-shaped in vertical section, and the side wall portions 20*b* are formed along the longitudinal direction, on the opposite sides of the lens 20 as viewed in the short-side direction, such that the side wall portions 20*b* are fitted in the case 11. With the side wall portions 20*b* thus provided, the strength of the lens 20 can be increased. Also, the side wall portions 20*b* of the lens 20 and the inner side faces of the case 11 make it possible to reflect the emitted light of the light source 32 irregularly or transmit the emitted light diffusively; therefore, the effects of the above paragraphs 1 can be further surely obtained.

8. As shown in FIG. 8, the inner bottom surface 12*b* of the main body 12 of the case 11 is formed as a concave, curved surface that is slightly curved along the short-side direction of the main body 12. Therefore, the inner bottom surface 12*b* can efficiently reflect the emitted light of the light source 32 toward the lens 20, and the effects of the above paragraphs 1 can be further surely obtained.

9. As shown in FIG. 8, the inner corner portions 20*e* at which the inner bottom surface 20*d* and inner side faces of the lens 20 are connected have round shape. If the inner corner portions 20*e* have a right-angled shape, the thickness of the lens 20 suddenly changes at the inner corner portions 20*e*; therefore, straight-line shadows of the inner corner portions 20*e* may be reflected on the light radiation surface 20*a* of the lens 20. However, this defect can be avoided in the illuminating device 10 in which the inner corner portions 20*e* have round shape.

This disclosure is not limited to the illustrated embodiments, but may be embodied as follows. In these cases, too, substantially the same or further effects as those of the illustrated embodiments can be obtained.

The light reflecting surfaces 15*a*, 16*a* of the light reflecting portions 15, 16 are not limited to the flat surfaces, but may be formed as curved surfaces, provided that the effects of the above paragraphs 1 can be surely obtained. The light reflecting surface may be recessed outward, provided that the light reflecting surface reflects emitted light of the light source 32 obliquely rearward of the light source 32, and reflects the emitted light toward the lens 20. Further, although the two light reflecting portions 15, 16 are provided in the embodiment, the number of the light reflecting portions may be one, or three or more. Further, a plurality of small light reflecting portions may be arranged in the direction of the light-source optical axis L.

At least one of the inner surface and the light radiation surface 20*a* of the lens 20 may be subjected to machining (e.g., embossing, or blast finishing) for forming minute recesses and projections. In this case, since the light diffusibility of the lens 20 is enhanced by the machining for making minute recesses and projections, light can be further evenly or uniformly emitted from the entire area of the light radiation surface 20*a* of the lens 20. When the light radiation surface 20*a* of the lens 20 is subjected to the machining for forming recesses and projections, there may be a problem that the machined surface is likely to be damaged if external force is applied from the outside of the illuminating device 10 to the light radiation surface 20*a*. On the other hand, if the inner surface of the lens 20 is subjected to machining for forming recesses and projections, this problem can be avoided. The lens 20 does not necessarily need to converge light or diffuse light, provided that the lens 20 controls the direction of light.

Technical concepts that can be grasped from the illustrated embodiment and other embodiments will be additionally stated below.

The front end portion of the lens may be formed such that the thickness of the bottom wall portion of the lens increases toward the front end, and the inner bottom surface of the lens may be a concave, curved surface that is curved along the longitudinal direction of the lens. With this arrangement, the index of refraction becomes higher toward the front end of the lens; therefore, light can be radiated from the light radiation surface of the lens, farther on the front side of the illuminating device, and the illuminating device can illuminate a wide area along the longitudinal direction of the case and the lens.

The lens may be U-shaped in vertical section, and the side wall portions, which are formed along the longitudinal direction, on the opposite sides of the lens as viewed in the short-side direction, may be fitted in the case. With this arrangement, the strength of the lens can be increased by provision of the side wall portions. Also, with this arrangement, the emitted light of the light source can be irregularly reflected by the side wall portions of the lens and the inner side faces of the case, so that the effects of the above paragraphs 1 and other paragraphs can be further surely obtained.

This disclosure is not limited to description of the above aspects, the above embodiments, and the above added matters. Various modified forms or embodiments are also included in the disclosure, within the range that can be easily conceived by those skilled in the art, without departing from description of the above aspects, the above embodiments, the above added matters and the appended claims. With regard to the content of the patent publication, etc. specified in this specification, the whole content of the publication is to be incorporated by citation.

What is claimed is:

1. An illuminating device, comprising:

a light source having a light-source optical axis;

a lens that is located substantially parallel to the light-source optical axis such that a surface of the lens faces the light-source optical axis, the lens extending to a position rearward of the light source in a direction of the light-source optical axis; and a light reflecting portion located so as to be opposed to a front side of the light source, the light reflecting portion being adapted to reflect emitted light of the light source obliquely rearward of the light source, and to reflect the emitted light toward the lens, wherein a light reflecting surface of the light reflecting portion includes an inclined surface that is inclined so as to be closer to the light source in the direction of the light-source optical axis, as a distance from the light-source optical axis increases in a direction perpendicular to the surface of the lens, wherein, excluding a front end portion of the lens, an inner bottom surface of the lens includes a flat surface and a bottom wall portion of the lens has a uniform thickness, wherein, in the front end portion of the lens, the inner bottom surface of the lens is formed as a curved surface curved along a longitudinal direction of the lens and the bottom wall portion of the lens is formed with a thickness increased toward the front end portion of the lens, and wherein the light reflecting portion extends to a position in order not to interrupt the light-source optical axis.

2. The illuminating device according to claim 1, further comprising a case in which the light source is provided in an end portion of the case in a longitudinal direction of the case, wherein the light-source optical axis extends in the longitudinal direction in the case, wherein the lens is located with a gap provided between the lens and an inner bottom surface of the case, and where the light reflecting portion is located in the case.

3. The illuminating device according to claim 2, wherein the case is substantially in a shape of a rectangular parallelepiped box, and includes an opening, wherein the lens is fitted in the opening of the case, and wherein the light-source optical axis is arranged to pass through a space formed by a gap between the case and the lens, without being interrupted by the case, the lens, and the light reflecting portion.

4. The illuminating device according to claim 2, wherein the light reflecting portion is connected to the inner bottom surface of the case, and wherein a height of the light reflecting portion as measured from the inner bottom surface of the case is about one-half of a gap between the case and the lens.

5. The illuminating device according to claim 2, wherein the light reflecting portion is connected to the inner bottom surface of the case; and wherein a height of the light reflecting portion as measured from the inner bottom surface of the case is in a range of ⅓ to ⅔ of a gap between the case and the lens.

6. The illuminating device according to claim 2, wherein the light reflecting portion is connected to the inner bottom surface of the case; and wherein a height of the light reflecting portion as measured from the inner bottom surface of the case is in a range of ⅓ to ½ of a gap between the case and the lens.

7. The illuminating device according to claim 2, wherein the case includes an inner surface having light reflectivity.

8. The illuminating device according to claim 1, wherein the light reflecting portion comprises a first member and a second member, wherein the first member and the second member are symmetric with respect to the light-source optical axis, and wherein the light-source optical axis is arranged to pass through a gap provided between the first member and the second member.

9. The illuminating device according to claim 1, wherein the light reflecting portion comprises a pair of reflecting portions located symmetrical with respect to the light-source optical axis.

10. The illuminating device according to claim 2, wherein a central axis of the case coincides with the light-source optical axis of the light source.

11. The illuminating device according to claim 2, wherein the light-source optical axis passes through the gap between the lens and the inner bottom surface of the case without being interrupted by the case.

12. The illuminating device according to claim 1, wherein, excluding the front end portion of the lens, an entirety of the inner bottom surface of the lens includes the flat surface.

13. The illuminating device according to claim 1, wherein, excluding the front end portion of the lens, an entirety of the bottom wall portion of the lens has the uniform thickness.

14. The illuminating device according to claim 1, wherein the lens is hollow and has a U-shape in a vertical section such that the inner bottom surface of the lens provides a light radiation surface.

15. The illuminating device according to claim 1, wherein the lens is hollow and has a U-shape in a vertical section such that an entirety of the inner bottom surface of the lens provides a light radiation surface.

16. The illuminating device according to claim 1, wherein, in a cross-sectional view, the thickness of the bottom wall portion of the lens continuously increases from an end of the flat surface of the inner bottom surface of the lens to the front end portion of the lens.

17. The illuminating device according to claim 1, wherein, in the curved surface, the thickness of the bottom wall portion of the lens continuously increases from an end of the flat surface of the inner bottom surface of the lens to the front end portion of the lens.

18. The illuminating device according to claim 1, wherein the light reflecting portion comprises a pair of reflecting portions, and the light-source optical axis passes through a gap formed between the pair of reflecting portions.

* * * * *